US006286932B1

(12) United States Patent
Hirano

(10) Patent No.: US 6,286,932 B1
(45) Date of Patent: Sep. 11, 2001

(54) RECORDING APPARATUS AND GRADATION RECORDING METHOD

(75) Inventor: Hirofumi Hirano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/839,384

(22) Filed: Apr. 18, 1997

Related U.S. Application Data

(63) Continuation of application No. 08/321,015, filed on Oct. 6, 1994.

(30) Foreign Application Priority Data

Oct. 8, 1993 (JP) ..... 5/253068

(51) Int. Cl.[7] ..... B41J 2/21; B41J 2/175
(52) U.S. Cl. ..... 347/43; 347/86
(58) Field of Search ..... 347/43, 100, 85, 347/86, 87

(56) References Cited

U.S. PATENT DOCUMENTS

| | | | | |
|---|---|---|---|---|
| 4,313,124 | | 1/1982 | Hara . | |
| 4,345,262 | | 8/1982 | Shirato et al. . | |
| 4,459,600 | | 7/1984 | Sato et al. . | |
| 4,463,359 | | 7/1984 | Ayata et al. . | |
| 4,543,590 | * | 9/1985 | Tazaki et al. | 347/43 |
| 4,558,333 | | 12/1985 | Sugitani et al. . | |
| 4,604,654 | | 8/1986 | Sakurada et al. . | |
| 4,672,432 | * | 6/1987 | Sakurada et al. | 347/43 |
| 4,713,746 | | 12/1987 | Watanabe et al. . | |
| 4,723,129 | | 2/1988 | Endo et al. . | |
| 4,740,796 | | 4/1988 | Endo et al. . | |
| 4,812,859 | * | 3/1989 | Chan et al. | 347/43 |
| 4,860,026 | * | 8/1989 | Matsumoto et al. | 347/15 |
| 5,220,342 | | 6/1993 | Moriyama | 347/43 |
| 5,406,392 | * | 4/1995 | Aoki et al. | 347/43 |
| 5,455,610 | * | 10/1995 | Harrington | 347/43 |
| 5,488,402 | * | 1/1996 | Shields et al. | 347/96 |
| 5,984,449 | | 11/1999 | Tajika et al. | 347/15 |

FOREIGN PATENT DOCUMENTS

| | | | | |
|---|---|---|---|---|
| 59-123670 | | 7/1984 | (JP) . | |
| 59-138461 | | 8/1984 | (JP) . | |
| 1-275046 | | 11/1989 | (JP) . | |
| 3-45351-A | * | 2/1991 | (JP) | 347/43 |
| 3-189167 | | 8/1991 | (JP) . | |
| 3-218851 | | 9/1991 | (JP) . | |

* cited by examiner

*Primary Examiner*—Thinh Nguyen
(74) *Attorney, Agent, or Firm*—Fitzpatrick, Cella, Harper & Scinto

(57) ABSTRACT

A recording apparatus is capable of reducing number of ink container, contributing enhancement of gradation, and is inexpensive and compact, and particularly suitable for serial type ink-jet printer. The recording apparatus has recording heads which can eject a plurality of kinds of inks and have ejection orifice arrays arranged in two columns for ejecting respective two kinds of inks per respective arrays, and ink cartridges respectively having integrally formed two ink containers in a direction perpendicular to the ejection orifices arrays.

13 Claims, 6 Drawing Sheets

RECORDING APPARATUS AND GRADATION RECORDING METHOD

This application is a continuation of application Ser. No.08/321,015 filed Oct. 6, 1994.

BACKGROUND OF THE INVENTION

1. Field of the Invention

The present invention relates to a recording apparatus. More specifically, the invention relates to an ink-jet type recording apparatus for performing recording by ejecting ink toward a recording medium.

2. Description of Related Art

As a recording apparatus, an ink-jet type recording apparatus has been employed in various applications. Especially, a bubble-jet type printing apparatus which generates bubbles in ink and ejects ink droplets by pressure of the bubbles for recording by forming dots on a recording medium, is becoming majority. On the other hand, according to an increasing demand for color printing in the recent years, gradation of density becomes to be given importance in order to obtain an image close to the natural color. In order to certainly obtain satisfactory gradation, various systems, such as a system controlling dot density, a system varying size of the dot, a system for using different density of inks and so forth have been employed.

However, in the case of the system controlling the dot density, size of the ink droplet to be ejected has to be made smaller and thus to make the pitch of ink ejection orifices smaller. Smaller pitch of the ejection orifices may cause difficulty in production. As well, smaller pitch of the ejection orifices may increase possibility of causing clogging of the orifices. Furthermore, for higher recording speed, a greater number of ink ejection orifices are required so as to increase the overall size of the apparatus.

On the other hand, in the case of the system varying the size of the dot, while no problem will be arisen in the construction and the number of ink ejection orifices and liquid passages therefor, in the bubble-jet system to generate bubbles in the ink by heat, heat history management for varying response speed to change the size of the ink droplets becomes necessary for controlling generation of bubbles. Particularly, when an image has high recording density, non-uniformity of density tends to be caused at leading and trailing ends.

Furthermore, in the system using different density of inks, while no constraint condition is present on a head side, and achieving of gradation or gray scale is relatively easy, it inherently requires a large number of ink containers to degrade operability in installation and removal of the ink containers. Especially, in the case of serial type recording apparatus, in which a plurality of ink containers are carried on a carriage together with recording heads for performing recording, the carriage per se inherently becomes bulky.

SUMMARY OF THE INVENTION

Paying attention to the problems in the prior art as set forth above and in order to solve the problems, it is an object of the present invention to provide a recording apparatus, which can reduce the number of ink containers, contribute enhancement of gradation quality, be inexpensive and compact with capability of multicolor printing, and be particularly suitable for a serial type ink-jet system.

According to one aspect of the invention, an ink-jet recording apparatus for gradation recording having a plurality of ink containers each storing one of a plurality of kinds of inks to be supplied to a recording head portion, comprises:

a plurality of ink cartridges, each having a plurality of the ink containers;

at least one of the ink cartridges having ink containers respectively storing yellow ink and black ink;

one of another ink cartridges having ink containers respectively storing high density ink and low density ink of cyan; and one of another ink cartridges having ink containers respectively storing high density ink and low density ink of magenta.

Preferably, the ink container storing yellow ink has smaller volume than the ink container storing black ink.

According to another aspect of the invention, a recording apparatus comprises:

transporting means for transporting a member to be recorded in a predetermined direction;

a carriage provided movable in a scanning direction;

a recording head portion mounted on the carriage, the recording head portion having a first recording head series including a plurality of recording heads in the same direction, each recording head having an ejection orifice array consisted of a plurality of ejection orifices arranged in a direction perpendicular to the scanning direction, and a second recording head series arranged spaced apart from the first recording head series in the scanning direction and including a plurality of recording heads in the same direction, each recording head having an ejection orifice array consisted of a plurality of ejection orifices arranged in a direction perpendicular to the scanning direction; and a plurality of ink cartridges, each having two ink containers respectively communicated with recording heads of the first and second recording head series aligned in the scanning direction.

In the preferred construction, the recording head portion may have the first and second recording head series arranged adjacent to each other and has reversed T-shaped cross-section, and the ink cartridge may be of reversed U-shaped configuration to be placed over the reversed T-shaped recording head portion. In such case, the first and second recording head series may have ink supply tubes communicated with respective recording heads, and each of the ink supply tubes is connected to an ink supply passage formed in the bottom of a leg portion of the U-shaped ink cartridge. Preferably, at least one of the ink cartridges has ink containers respectively storing yellow ink and black ink, one of another ink cartridges has ink containers respectively storing high density ink and low density ink of cyan, and one of another ink cartridges has ink containers respectively storing high density ink and low density ink of magenta.

The recording head portion may have the first and second recording head series arranged in spaced apart from each other with a predetermined distance, and among a plurality of ink cartridges, and ink cartridges positioned at both ends in the direction perpendicular to the scanning direction may be formed into reversed W-shaped configuration. In such case, the first and second recording head series may have ink supply tubes communicated with respective recording heads, and each of the ink supply tubes is connected to an ink supply passage formed in the bottom of a leg portion of the ink cartridge. Also, the reversed W-shaped ink cartridge may have communicating portion at the lower portion of leg portions of each ink container.

The ink cartridge arranged at the center in the direction perpendicular to the scanning direction may be of reversed U-shaped configuration and have ink containers respectively storing yellow ink and black ink, one of ink cartridges at both ends may have ink containers respectively storing high density ink and low density ink of cyan, and the other ink cartridge may have ink containers respectively storing high density ink and low density ink of magenta.

Preferably, at least one of the ink cartridges may have ink containers respectively storing yellow ink and black ink, one of another ink cartridges may have ink containers respectively storing high density ink and low density ink of cyan, and one of another ink cartridges may have ink containers respectively storing high density ink and low density ink of magenta, and the apparatus may comprise means for performing gradation representation upon gradation recording, by using only the yellow ink for yellow color, and the high density inks and low density inks for magenta and cyan color respectively, and the black ink and processed black ink for black color.

According to a further aspect of the invention, a recording apparatus having an ink cartridge housing ink containers storing a plurality of kinds of inks to be supplied to a recording head portion per respective kind, the ink cartridge being directly connected to the recording portion, comprises:

the recording head portion having ejection orifice arrays arranged in two columns for ejecting each of two kinds of inks among a plurality of kinds of inks through one of the ejection orifice arrays arranged in two columns;

the ink cartridge storing the two kinds of inks and having integrally formed two ink containers in a direction perpendicular to the orientation of the ejection orifice arrays.

Preferably, the recording apparatus may include a plurality of ink cartridges each having two ink containers and a plurality of kinds of inks can be supplied to the recording head portion from the plurality of ink cartridges. Then, the ink cartridge may be directly connected to the recording head portion from the above, and the recording head portion has the ejection orifice arrays ejecting ink downwardly. If necessary, the two ink containers may have mutually different volumes.

According to a still further aspect of the invention, a gradation recording method comprises the steps of:

providing a plurality of ink cartridges having ink containers respectively storing mutually different kinds of inks;

filling a predetermined color of ink and black ink in at least one of the ink cartridges, and filing high density ink and low density ink of other colors in each of the remaining ink cartridges;

connecting the ink cartridges filled with the inks to a recording head per kinds of inks; and performing gradation representation employing only the predetermined color of ink for the predetermined color, high density ink and low density inks for respective of other colors and black ink and process ink for black.

In practice, the predetermined color may be yellow and the other colors may be cyan and magenta.

According to a yet further aspect of the invention, a gradation recording method comprises the steps of:

providing three ink cartridges having ink containers respectively storing two kinds of inks;

filling yellow ink and black ink in one of the ink cartridges, and filing high density ink and low density ink of cyan and magenta in remaining ink cartridges, respectively;

connecting the ink cartridges filled with the inks to a recording head per kinds of inks; and performing gradation representation employing only the yellow ink for yellow, high density ink and low density ink for respective of magenta and cyan and black ink and process ink for black.

According to the present invention, two kinds of inks are stored in respective ink containers per each ink cartridge. From the representation respective ink containers, different kinds of inks are supplied to respective ejection orifice arrays on a recording head portion, which ejection orifice are arrays aligned in two columns. For instance, by storing high and low density (thick and thin) inks of the same color in adjacent ink containers and ejecting high and low density inks through respective ejection orifice arrays, gradation can be provided for the corresponding color. It is also possible to store different inks in respective ink containers. Thus, according to the present invention, multicolor and multilevel gradation recording can be performed with minimum number of ink cartridges. Furthermore, in order to permit economical exchange, different capacity of ink containers may be provided in one ink cartridge.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The preferred embodiments of a recording apparatus according to the present invention will be discussed hereinafter with reference to the drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
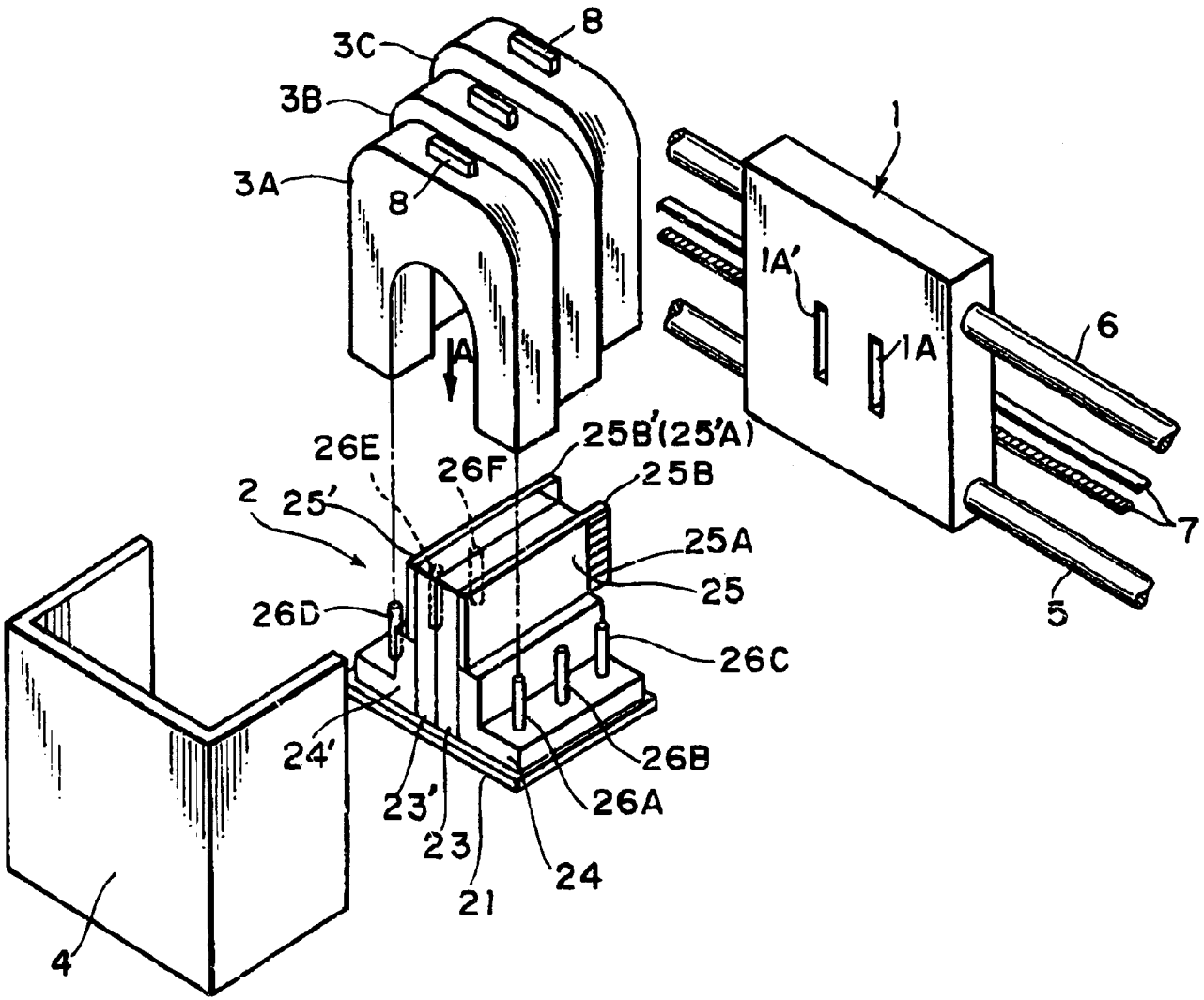
FIG. 1 is an exploded perspective view showing the construction around a recording head and an ink cartridge in the first embodiment of a recording apparatus according to the present invention.
Figure 8:
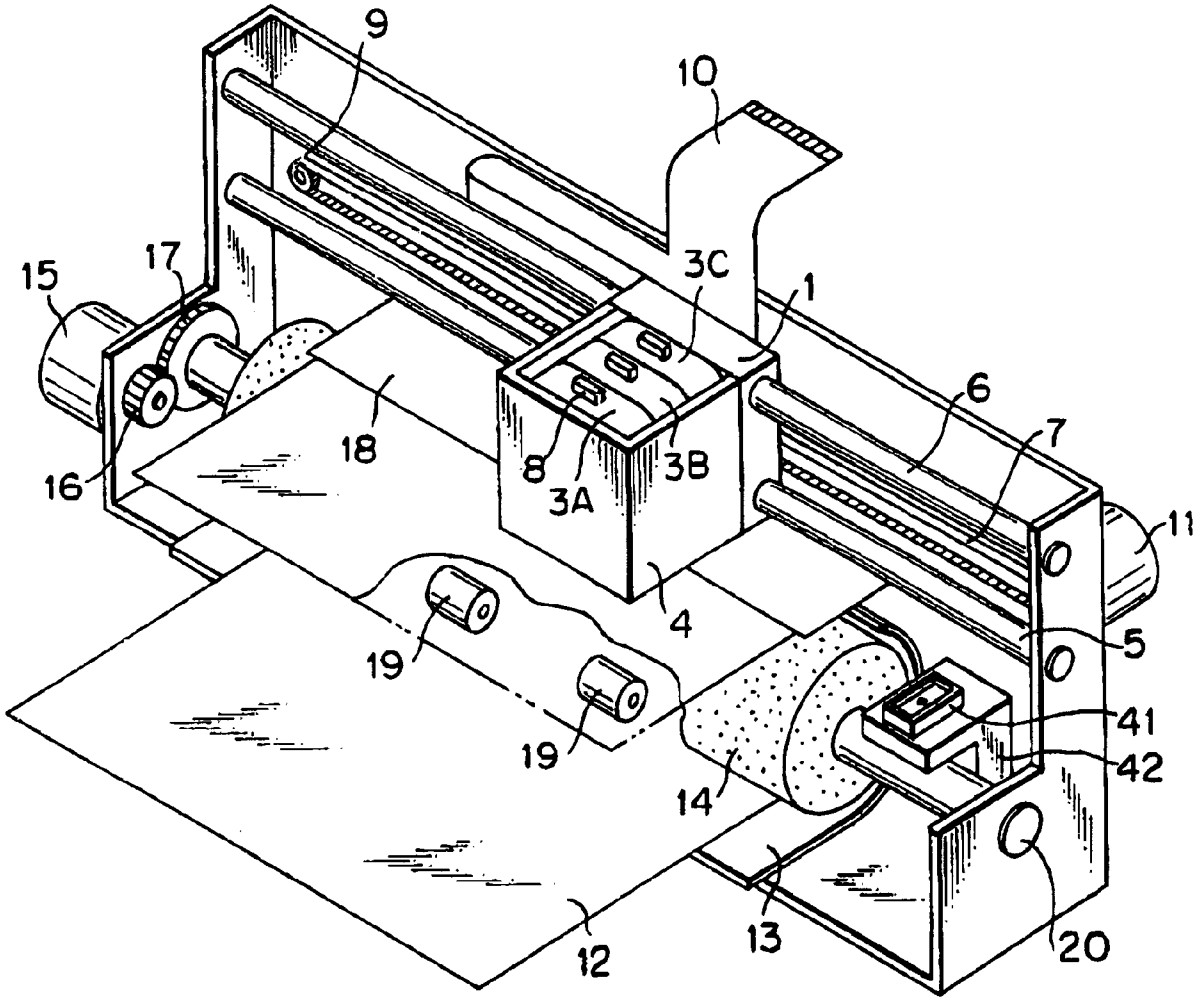
FIG. 8 is a perspective view showing one example of an ink-jet recording apparatus, to which the present invention is applied.

At first, one example of an ink-jet recording apparatus, to which the present invention is applicable, is shown in FIG. 8. Here, reference numeral 1 denotes a carriage mounting a recording head portion 2 (not shown in FIG. 8) and a plurality of ink cartridges 3A, 3B and 3C together with a head cover 4 and being movable for scanning. Reference numerals 5 and 6 are guide shafts for guiding the carriage 1 along a recording medium, such as a recording paper sheet or so forth. Reference numeral 7 denotes a timing belt guided by idler pulleys 9, connected to the carriage 1 at both ends, and driven by a carriage driving motor 11 at a predetermined timing. Reference numeral 10 denotes a flexible cable for transmitting signals representative of image information, driving conditions, ink conditions to be used and so forth from a control means (not shown) to the recording head portion 2. Transportation of a recording paper sheet 12 during recording and scanning is performed by driving a paper feed roller 14 by a paper feed motor 15 through a motor pinion 16 and a paper feed gear 17 mounted on a paper feed roller shaft 20. At this time, a transporting path of the recording paper sheet is defined by a paper pan, a pressing plate 18 formed with a thin plate and a pinch roller 19. On the other hand, reference numeral 41 denotes a cap for preventing the recording head 2 from drying or so forth, 42 denotes a recovery unit for performing sucking recovery operation or so forth for the recording head 2 via the cap 41. It should be noted that the ink cartridges 3A, 3B and 3C are formed into reversed U-shaped configuration as shown in FIG. 1. Each of the ink cartridges 3A, 3B and 3C can be installed and removed in a manner guided by the head cover 4 for exchanging independently of the others. The recording head portion 2 is fixed by the head cover 4 in the position installed on the carriage 1. The recording head portion 2 is adapted to receive electric signals via the carriage 1. Reference numeral 8 denotes grips formed on the tops of respective ink cartridges 3A, 3B and 3C.

Figure 2:
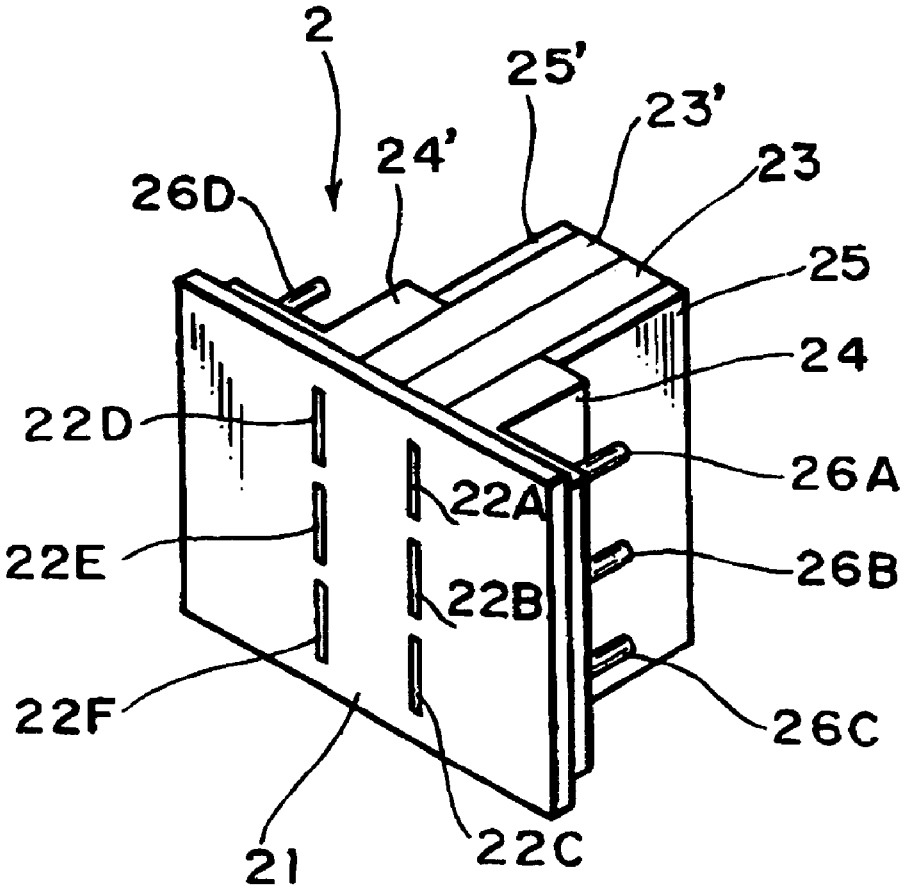
FIG. 2 is a perspective view showing a construction of a recording head portion to be employed in the first embodiment of the recording apparatus according to the invention.

Next, discussion will be given for the recording head portion 2 with reference to FIGS. 1 and 2.

It should be noted that in the shown embodiment, six kinds of inks are supplied from the ink cartridges 3A, 3B and 3C for performing recording therewith. Accordingly, in a ejection board 21 of the recording head portion 2, six of ink ejection orifice arrays 22A to 22F are formed and arranged in two columns. In the shown embodiment, each of ink ejection orifice arrays is consisted of sixty-four ejection orifices arranged in line. Between adjacent ejection orifice arrays in the same column, e.g. the ejection orifice arrays 22A and 22B, 23B and 22C, a predetermined gap (e.g. a distance corresponding to a distance between eight or sixteen ejection orifices) is provided. This is for facilitating avoidance of a band-line which can be caused in a serial printer by sequential shifting of the connecting portion between respective colors during recording.

Also, the ink ejection orifice arrays 22A and 22D, 22B and 22E, and 22C and 22F are located in parallel with respect to the direction of the scanning motion of the carriage 1. Also, the distance between the first column of ink ejection orifice arrays 22A to 22C and the second column of ink ejection orifice arrays 22D to 22F, is defined to be integral multiples of a feed pitch in the scanning motion direction, such as half inches, 1 inch and so forth. Reference numerals 23 and 23' denote base plates arranged perpendicularly to the ejection board 21 and integrally holding ink supply portions 24 and 24' and printed circuit boards 25 and 25' together with the ejection board 21. Reference numerals 26A, 26B and 26C denote ink supply tubes provided in the ink supply portion 24, and 26D, 26E and 26F denote ink supply tubes provided in the ink supply portion 24'.

It should be noted that each of the ink supply tubes 26A to 26F is designed to introduce ink into the corresponding each of ink ejection orifice arrays 22A to 22F (see FIG. 2) via a common liquid chamber and ink passages, each of which defines an ink ejection orifice at its end (not shown), provided in the ink supply portions 24 and 24', respectively. Also, it should be noted that on the base plate 23, 23', electrothermal transducer elements for providing energy for ejecting ink with respect to the ink passages are arranged. Reference numeral 25A and 25'A shown in FIG. 1 are electrode patterns respectively provided on a projecting portion 25B of the printed circuit board 25 and a projecting portion 25'B of the printed circuit board 25'. By inserting these projecting portions 25B and 25'B into connection holes 1A and 1A' of the carriage 1, the printed circuit boards 25 and 25' are electrically connected to electrode portions (not shown) arranged in the carriage 1 via the electrode patterns 25A and 25'A.

Figure 3:
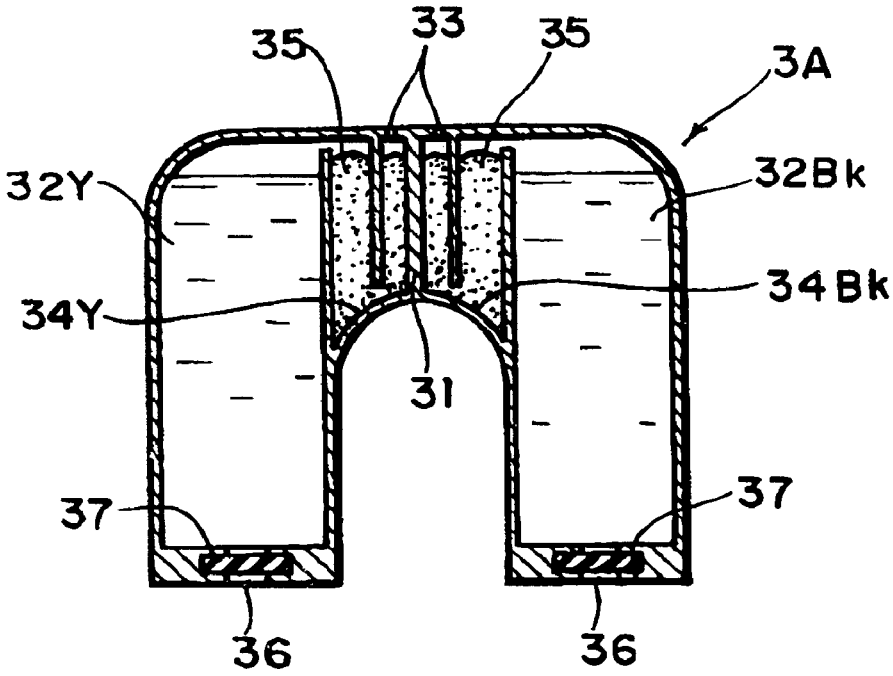
FIG. 3 is a section showing a construction of the ink cartridge to be employed in the first embodiment of the recording apparatus according to the invention.
Figure 4:
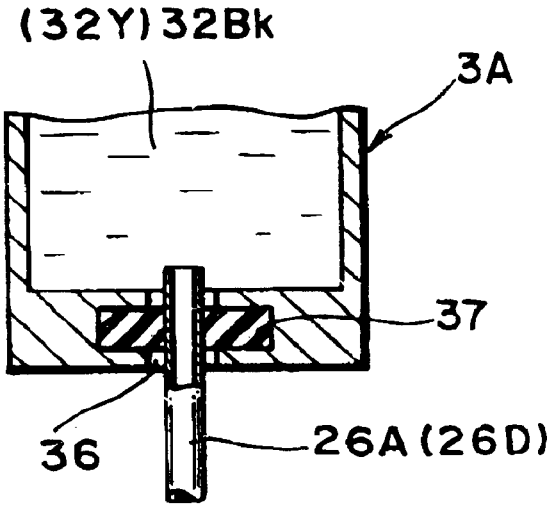
FIG. 4 is an explanatory sectional illustration showing installed condition of the ink cartridge shown in FIG. 3 to the recording head portion.

Next, constructions of the ink cartridges 3A to 3C according to the present invention will be discussed with reference to FIGS. 3 and 4. It should be appreciated that while the following discussion will be given for only one ink cartridge 3A, other ink cartridges 3B and 3C are constructed in the same fashion as the ink cartridge 3A. As shown in FIG. 3, the ink cartridge 3A is formed into a hollow reversed U-shaped configuration. The interior space of the ink cartridge 3A is divided into two ink containers 32Y and 32Bk by a central partitioning wall 31. In this embodiment, yellow (Y) ink is stored in the ink container 32Y and black (Bk) ink is stored in the ink container 32Bk. Reference numeral 33 denotes an atmosphere communication opening formed at the tops of respective ink containers 32Y and 32Bk, 34Y and 34Bk denote atmosphere communicating chambers, and 35 denotes ventilation members of a porous material installed in the atmosphere communicating chambers 34Y and 34Bk.

Also, in the bottom of leg portions of respective ink containers 32Y and 32Bk, an ink supply passage 36 is provided. In the ink supply passage 36, a plug member 37 formed from an elastic material, such as a rubber, is disposed. The ink cartridge 3A is installed over the central portion of substantially reversed T-shaped recording head portion 2 by pressing the cartridge 3A in the direction toward the ink supply tubes 26A and 26D along arrow A shown in FIG. 1. Then, the ink supply tubes 26A and 26D pass through the plug members 37 to establish connection for supplying inks with maintaining liquid tight seal around the ink supply tubes 26A and 26D extending through the plug members. Here, the plug member 37 is formed from the elastic material for maintaining liquid tight seal even after the ink supply tube passes therethrough as mentioned above, and the ink supply tubes 26A and 26D are formed in the form of an injection needle. Such construction reduces a necessary force in installation of the ink cartridge 3A. Furthermore, when the ink cartridge 3A is removed with withdrawing the ink supply tubes 26A and 26D, the plug members 37 are elastically restored to the original state, then respective holes formed by the ink supply tubes 26A and 26D in the plug members 37 can be blocked to prevent ink leakage.

Moreover, the ink cartridges 3B and 3C are constructed in the same construction as the ink cartridge 3A as set forth above. In the two ink containers of the ink cartridge 3B, cyan and pale cyan, for example, are stored as inks to be supplied to the ink ejection orifice arrays 22B and 22E via the ink supply tubes 26B and 26E, respectively. Similarly, in the two ink containers of the ink cartridge 3C, magenta and pale magenta, for example, are stored as inks to be supplied to the ink ejection orifice arrays 22C and 22F via the ink supply tubes 26C and 26F, respectively.

Next, discussion will be given for the operation of the recording apparatus for performing recording with employing the recording head portion 2 and ink cartridges 3A to 3C constructed as set forth above. In the shown embodiment, the recording head portion 2 is installed downwardly to perform recording by downwardly ejecting inks. Since the ink cartridges 3A to 3C are formed into reversed U-shaped configuration, inks may smoothly move downwardly even though the interior space thereof is divided into two chambers. Also, since atmosphere communication openings 33 are provided at the upper most portions of respective ink cartridges 3A to 3C, ink leakage during recording can be successfully prevented. Furthermore, when certain color of ink, such as cyan ink, is consumed out during recording, since the high and low density (thick and thin) inks of the same color are stored in the common ink cartridge, only the ink cartridge 3B containing cyan inks can be exchanged. When black ink or yellow ink is consumed out, it can be easily noticed from the result of recording.

Though pale yellow ink is not provided in this embodiment, debasement of the printed image quality may not be caused. This is because it is difficult to discriminate normal yellow from pale yellow with human eyes. Pale color recording of yellow is performed by reducing the number of recording dots. As pale color of the black ink, a process black (mixture of three colors of cyan, magenta and yellow) prepared in an image forming control portion can be used for gray scaling. By addition of black ink to the process black, the range of the gray scale can be further widened. The process black (hereinafter referred to as PBK) mentioned before is a black created in additive color mixture by printing three colors of yellow, magenta and cyan at the same position. This PBK typically becomes paler than a real black (black color by the black ink). This tendency is significant in the case of an ink having a high permeation rate, such as so-called super permeative type ink. As a result, in comparison with the real black ink, the PBK becomes a gray tone.

It is a reason of creation of this gray tone by the above-mentioned manner of additive color mixture that, in the case of PBK, respective colors of inks are ejected in order so that the prior ejected ink forms a lower layer, in different from the case where cyan, magenta and yellow color inks are completely mixed, and therefore, depending upon a relationship between fibers of paper and transmittance of respective colors, overall blackness is lowered.

When the foregoing PBK is employed as a method for widening the gray scale representation range, it is also possible to print adjacent dots with a different combination of two colors, such as yellow and magenta on one dot and yellow and cyan on adjacent the other dot, with neglecting respective one color to create PBK with two dots. With taking this way to create PBK, further paler black can be represented.

In contrast to this, when a method to print one real black dot for the region of two dots to represent paler black, while blackness can be lowered in appearance, graininess (granular feeling) may be increased and presence of one blank dot reduces overall granularity and whereby to degrade image quality and resolution.

Accordingly, by employing PBK created by adjacent dots printed with a mutually different combination of two colors, in addition to high and low density dots created by PBK and real black, respectively, wider gray scaling can be realized without causing degradation of the granularity.

It should be noted that when tone is varied by employing real black and PBK, it is most preferable to adjust yellow, magenta and cyan for creating PBK which may have equivalent blackness to the real black within a color space.

Also, as a gray scaling expressing means in the case of PBK, by adjusting printing intervals for the second and the third colors in consideration of ink permeation and evaporation of the first color, further delicate gray tone can be represented. In addition, by printing real black ink dots at an arbitrary selected dot interval on the PBK dots printed region, the range of gray tone representation can be further expanded for improvement in gradation quality.

Also, concerning images, such as characters, which do not require gray tone, real black ink may be used for printing to permit recording of high quality characters or images.

Figure 5:
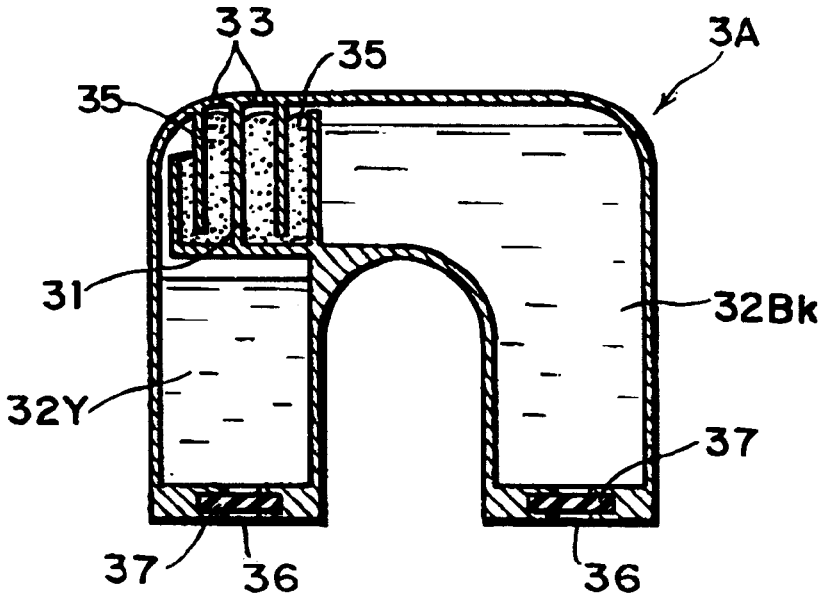
FIG. 5 is a section showing the construction of the ink cartridge to be employed in the second embodiment of the recording apparatus according to the invention.

FIG. 5 shows a construction of an ink cartridge according to the second embodiment of the invention. In the shown embodiment, the position of the partitioning wall 31 in each of the ink cartridges 3A to 3C is shifted so as to vary the volumes of two ink containers defined in the ink cartridge. For instance, in the case of the ink cartridge 3A comprising the ink containers 32Y and 32Bk, the ink container 32Y is provided smaller volume than the ink container 32Bk. By this construction, the black ink, which is used frequently in character printing and so forth, can be stored in the greater volume than that of the yellow ink. It should be noted that pale color recording of yellow is performed by reducing the number of recording dots as mentioned above. As set forth, depending upon the kind of ink, the volumes of the two ink containers can be appropriately adjusted so that exchanging timing of the ink cartridge can be set at substantially equal consumption rates of the inks in both ink containers.

Figure 6:
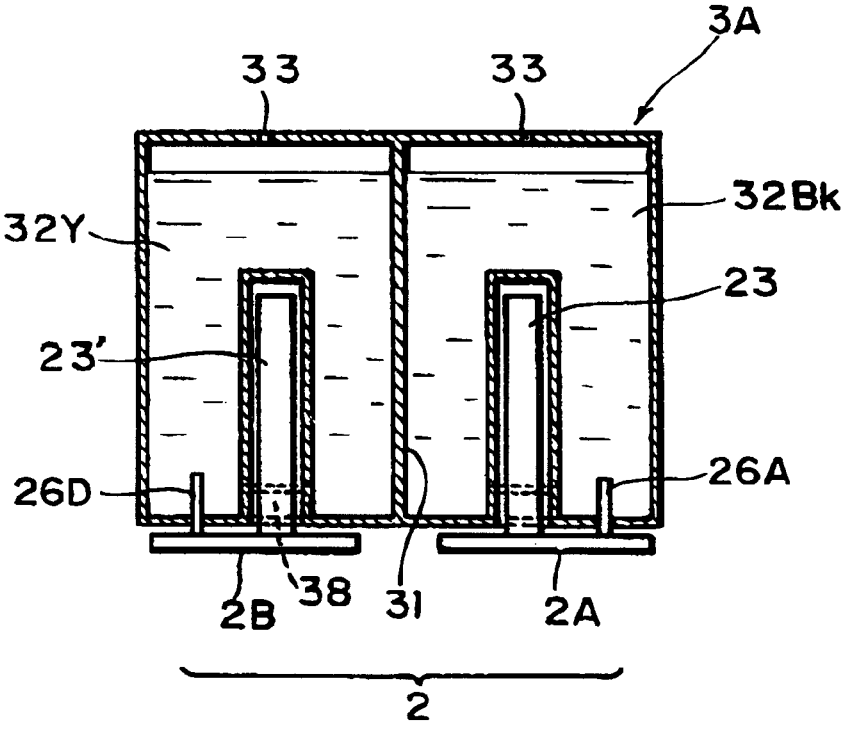
FIG. 6 is a section showing installed condition of the ink cartridge in the third embodiment of the recording apparatus to the recording head portion.
Figure 7:
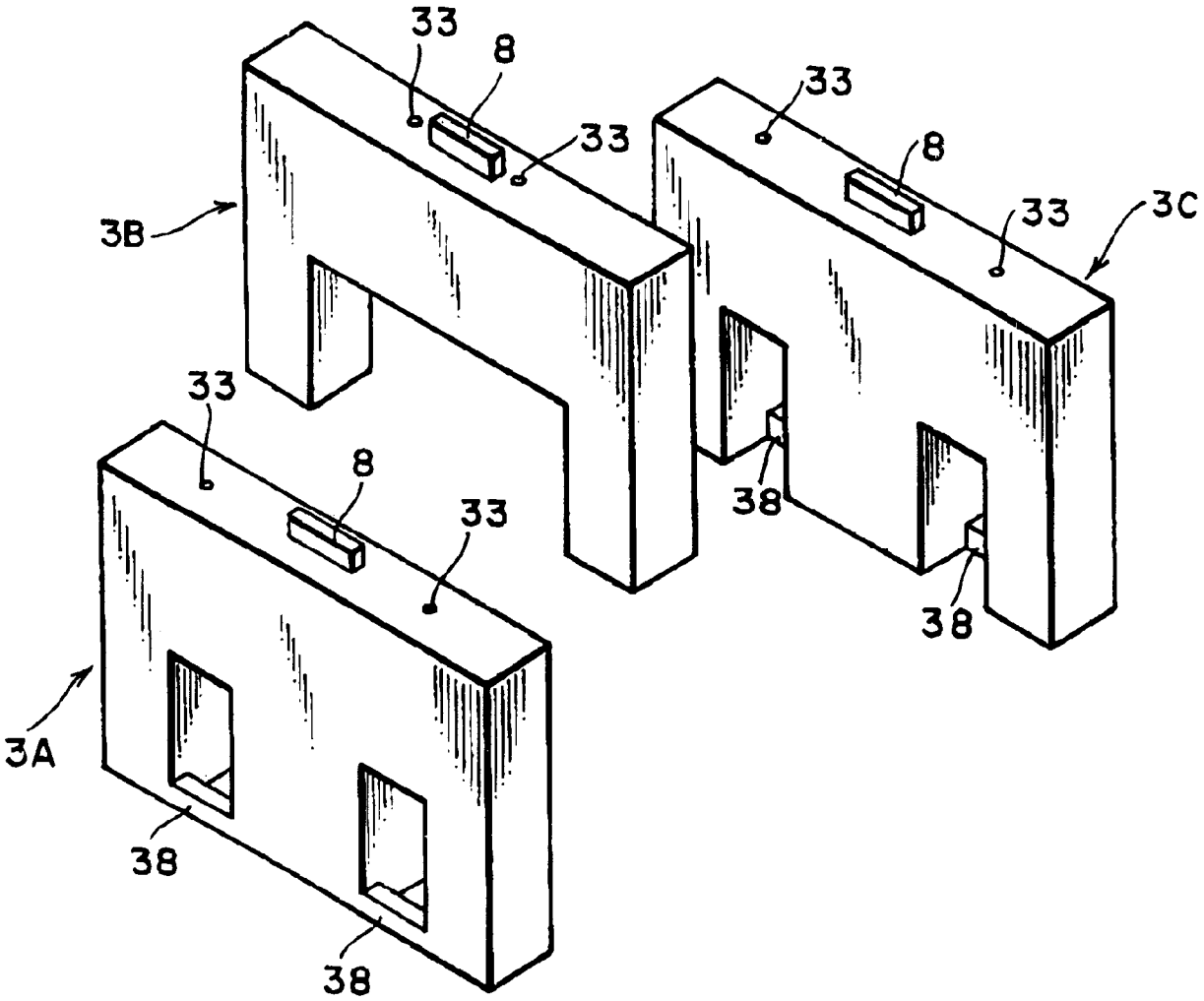
FIG. 7 is a perspective view showing the construction of the third embodiment of the ink cartridge in the third embodiment of the recording apparatus.

FIGS. 6 and 7 show constructions of an ink cartridge and a recording head portion according to the third embodiment of the invention. In FIG. 6, the recording head portion 2 employs two heads 2A and 2B arranged on the carriage 1 with a predetermined space, differently from the foregoing first and second embodiments. In the shown embodiment, the heads 2A and 2B are not formed integrally and are mounted with independently positioning on the carriage. This makes production of the heads 2A and 2B easier. In addition, with this construction, the recording apparatus can be commonly used for monochrome printing and color printing. In the shown embodiment, in order to use the space between the heads 2A and 2B effectively, the ink cartridges 3A and 3C out of 3A to 3C are formed into reversed W-shaped configurations so that ink may also be stored in the clearance between the heads 2A and 2B. In the shown case, the ink cartridge 3B is formed into the reversed U-shaped configuration similarly to the foregoing first and second embodiments. This is because difficulty in formation of a later-mentioned ink communicating portion.

The ink cartridge 3A in the shown embodiment has the partitioning wall 31 at the center portion, and both of the ink containers 32Y and 32Bk are mounted over base plates 23 and 23' of the heads 2A and 2B. The ink containers 32Y and 32Bk are provided with ink communicating portions 38 at the lower portion of the leg portions of the ink containers for communication of inks, in the form of avoiding interference with the side edges of the base plates 23 and 23' as shown in FIG. 7. Since the ink communicating portions 38 are formed to avoid interference with the base plates 23 and 23', they may not disturb installation and removal of the ink cartridges 3A and 3C. Within the ink communicating portions 38, ink passages for communicating ink stored on both sides of the respective recording heads 2A and 2B are formed.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. No. 4,723,129 and U.S. Pat. No. 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. No. 4,463,359 and U.S. Pat. No. 4,345,262 are preferable. In addition, it is preferable that the rate of temperature rise of the heating portions described in U.S. Pat. No. 4,313,124 be adopted to achieve better recording.

U.S. Pat. No. 4,558,333 and U.S. Pat. No. 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet recording apparatus for gradation recording having a plurality of ink containers each storing one of a plurality of kinds of ink for supply to a recording head portion, comprising:

a plurality of ink cartridges, each having a plurality of said ink containers;

at least one of said ink cartridges having ink containers respectively storing yellow ink and black ink;

one of another ink cartridges having ink containers respectively storing high density ink and low density ink of cyan; and one of another ink cartridges having ink containers respectively storing high density ink and low density ink of magenta.

2. An ink-jet recording apparatus as claimed in claim 1, wherein said ink container storing yellow ink has smaller volume than said ink container storing black ink.

3. A recording apparatus comprising:

transporting means for transporting, in a predetermined direction, a member on which recording is performed;

a carriage provided movable in a scanning direction;

a recording head portion mounted on said carriage, said recording head portion having a first recording head series including a plurality of recording heads arranged in a same direction being a head arrangement direction, each recording head having an ejection orifice array comprising a plurality of ejection orifices arranged in a direction perpendicular to said scanning direction, and a second recording head series arranged spaced apart from said first recording head series in the scanning direction and including a plurality of recording heads arranged in the head arrangement direction, each recording head having an ejection orifice array comprising a plurality of ejection orifices arranged in the direction perpendicular to said scanning direction; and a plurality of ink cartridges, each having two ink containers respectively communicated with the recording heads of said first and second recording head series aligned in said scanning direction, wherein said recording head portion has said first and second recording head series arranged adjacent to each other and has reversed T-shaped cross-section, and said ink cartridge is of reversed U-shaped configuration for placement over said reversed T-shaped recording head portion.

4. A recording apparatus as claimed in claim 3, wherein said first and second recording head series have ink supply tubes communicated with respective recording heads, each of said ink supply tubes being connected to an ink supply passage formed in a bottom of a leg portion of said U-shaped ink cartridge.

5. A recording apparatus as claimed in claim 4, wherein at least one of said ink cartridges has ink containers respectively storing yellow ink and black ink, one of another ink cartridges has ink containers respectively storing high density ink and low density ink of cyan, and one of another ink cartridges has ink containers respectively storing high density ink and low density ink of magenta.

6. A recording apparatus comprising:

transporting means for transporting, in a predetermined direction, a member on which recording is performed;

a carriage provided movable in a scanning direction;

a recording head portion mounted on said carriage, said recording head portion having a first recording head series including a plurality of recording heads arranged in a same direction being a head arrangement direction, each recording head having an ejection orifice array comprising a plurality of ejection orifices arranged in a direction perpendicular to said scanning direction, and a second recording head series arranged spaced apart from said first recording head series in the scanning direction and including a plurality of recording heads arranged in the head arrangement direction, each recording head having an ejection orifice array comprising a plurality of ejection orifices arranged in the direction perpendicular to said scanning direction; and a plurality of ink cartridges in an array in the direction perpendicular to said scanning direction, the array having a first end and a second end, each of the ink cartridges having two ink containers respectively communicated with the recording heads of said first and second recording head series aligned in said scanning direction, wherein the first recording head series and the second recording head series are spaced apart from each other at a predetermined distance, and the ink cartridges among said plurality of ink cartridges positioned at the first end and the second end are formed into a reversed W-shaped configuration.

7. A recording apparatus as claimed in claim 6, wherein said first and second recording head series have ink supply tubes communicated with respective recording heads, each of said ink supply tubes being connected to an ink supply passage formed in a bottom of a leg portion of said U-shaped ink cartridge.

8. A recording apparatus as claimed in claim 6, wherein said reversed W-shaped ink cartridge has a communicating portion at a lower portion of leg portions of each ink container.

9. A recording apparatus as claimed in claim 6, wherein the ink cartridge arranged at a center in the direction perpendicular to said scanning direction is of reversed U-shaped configuration and has ink containers respectively storing yellow ink and black ink, one of ink cartridges at both ends has ink containers respectively storing high density ink and low density ink of cyan, and another ink cartridge has ink containers respectively storing high density ink and low density ink of magenta.

10. A recording apparatus comprising:

transporting means for transporting, in a predetermined direction, a member on which recording is performed;

a carriage provided movable in a scanning direction;

a recording head portion mounted on said carriage, said recording head portion having a first recording head series including a plurality of recording heads arranged in a same direction being a head arrangement direction, each recording head having an ejection orifice array comprising a plurality of ejection orifices arranged in a direction perpendicular to said scanning direction, and a second recording head series arranged spaced apart from said first recording head series in the scanning direction and including a plurality of recording heads arranged in the head arrangement direction, each recording head having an ejection orifice array comprising a plurality of ejection orifices arranged in the direction perpendicular to said scanning direction;

a plurality of ink cartridges, each having two ink containers respectively communicated with the recording heads of said first and second recording head series aligned in said scanning direction, wherein at least one of said ink cartridges has ink containers respectively storing yellow ink and black ink, one of another ink cartridges has ink containers respectively storing high density ink and low density ink of cyan, and one of another ink cartridges has ink containers respectively storing high density ink and low density ink of magenta; and means for performing gradation representation upon gradation recording, by using only said yellow ink for yellow color, said high density inks and low density inks for magenta and cyan color respectively, and said black ink and an additive color mixture of yellow, magenta and cyan inks for black color.

11. A gradation recording method comprising the steps of:

providing a plurality of ink cartridges having ink containers respectively storing mutually different kinds of inks;

filling a predetermined color of ink and black ink in at least one of said ink cartridges, and filling high density ink and low density ink of other colors in each remaining ink cartridge;

connecting said ink cartridges filled with the inks to a recording head per kinds of inks; and performing gradation representation by forming dots on a recording medium, said dots employing only said predetermined color of ink for said predetermined color, employing high density ink and low density ink for respective other colors and employing black ink and a process black ink which is created by printing said predetermined color of ink and respective inks of other colors in order at the same position on said recording medium for black.

12. A gradation recording method as claimed in claim 11, wherein said predetermined color is yellow and said other colors are cyan and magenta.

13. A gradation recording method comprising the steps of:

providing three ink cartridges having ink containers respectively storing two kinds of inks;

filling yellow ink and black ink in one of said ink cartridges, and filling high density ink and low density ink of cyan and magenta in remaining ink cartridges, respectively;

connecting said ink cartridges filled with the inks to a recording head per kinds of inks; and performing gradation representation by forming dots on a recording medium, said dots employing only said yellow ink for yellow, employing high density ink and low density ink for magenta and cyan, and employing black ink and a process black ink which is created by printing said yellow ink and respective inks of magenta and cyan in order at the same position on said recording medium for black.

* * * * *

UNITED STATES PATENT AND TRADEMARK OFFICE

CERTIFICATE OF CORRECTION

PATENT NO. : 6,286,932 B1
DATED : September 11, 2001
INVENTOR(S) : Hirano

It is certified that error appears in the above-identified patent and that said Letters Patent is hereby corrected as shown below:

Column 2,
Line 56, "in" should read -- so as to be --.

Column 3,
Lines 49 and 65, "filing" should read -- filling --.

Column 4,
Line 11, "are" should read -- arrays are --.

Column 5,
Line 4, "to unnecessary" should read -- not to needlessly --.

Column 7,
Line 19, "upper most" should read -- uppermost --;
Line 50, "in different" should read -- as distinguished --; and
Line 59, "adjacent the other" should read -- the adjacent --.

Column 8,
Line 47, "independently" should read -- independent --; and
Line 58, "because" should read -- because of --.

Column 9,
Line 63, "consists" should read -- consist --.

Signed and Sealed this

Twenty-sixth Day of March, 2002

*Attest:*

*Attesting Officer*

JAMES E. ROGAN
*Director of the United States Patent and Trademark Office*